US008152418B2

(12) United States Patent
Jenkins et al.

(10) Patent No.: US 8,152,418 B2
(45) Date of Patent: Apr. 10, 2012

(54) DEPLOYING A CHEMICALLY-INFLATABLE BAG WITH AN UNFURLING ACTION

(75) Inventors: Sanford S. Jenkins, Lee's Summit, MO (US); Thomas S. Jenkins, Lee's Summit, MO (US)

(73) Assignee: Stemlock, Incorporated, Lee's Summit, MO (US)

( * ) Notice: Subject to any disclaimer, the term of this patent is extended or adjusted under 35 U.S.C. 154(b) by 333 days.

(21) Appl. No.: 12/504,447

(22) Filed: Jul. 16, 2009

(65) Prior Publication Data

US 2011/0011481 A1 Jan. 20, 2011

(51) Int. Cl.
*B65D 25/08* (2006.01)

(52) U.S. Cl. ..... 405/303; 405/232; 53/474; 53/469; 383/3; 206/219

(58) Field of Classification Search ..... 405/232, 405/247, 272, 303; 206/219, 221; 383/3, 383/38; 53/469, 474; 166/295, 187, 292
See application file for complete search history.

(56) References Cited

U.S. PATENT DOCUMENTS

| | | | | |
|---|---|---|---|---|
| 3,058,313 | A | | 10/1962 | Robbins |
| 3,542,032 | A | | 11/1970 | Spencer, Jr. |
| 3,639,952 | A | | 2/1972 | Thompson et al. |
| 3,749,620 | A | | 7/1973 | Montgomery |
| 4,151,787 | A | | 5/1979 | Rohr et al. |
| 4,630,727 | A | | 12/1986 | Feriani et al. |
| 4,781,645 | A | | 11/1988 | Kato |
| 4,805,767 | A | * | 2/1989 | Newman ..... 206/219 |
| 4,846,278 | A | | 7/1989 | Robbins |
| 4,896,794 | A | | 1/1990 | Banks et al. |
| 5,305,582 | A | | 4/1994 | Abbott |
| 5,501,284 | A | | 3/1996 | Clodfelter et al. |
| 5,588,532 | A | | 12/1996 | Pharo |
| 5,619,840 | A | | 4/1997 | Nyman et al. |
| 6,619,387 | B2 | | 9/2003 | Jenkins et al. |
| 6,722,105 | B2 | | 4/2004 | Jenkins et al. |
| 7,284,982 | B2 | | 10/2007 | Brattesani |
| 2005/0029148 | A1 | | 2/2005 | Rust |

OTHER PUBLICATIONS

PCT Search Report and Written Opinion in International Application PCT/US10/042322.

Notification of Transmittal of International Preliminary Report on Patentability in PCT Application PCT/US10/42322, dated Aug. 24, 2011, 15 pages.

* cited by examiner

*Primary Examiner* — John Kreck
*Assistant Examiner* — Sean Andrish
(74) *Attorney, Agent, or Firm* — Shook Hardy & Bacon LLP

(57) ABSTRACT

Embodiments provide an apparatus and methods for providing a nonlabor-intensive process for preventing backfill entering, or environmental factors eroding, a cavity formed in the ground. Preventing cavity degradation involves constructing a chemically-inflatable bag that separates two or more chemical reactants by creases and cylindrical coils formed in the chemically-inflatable bag. The creases typically act as watertight releasable seals that separate the chemical reactants while the cylindrical coils resist unintentional compromise of the releasable seals. However, the cylindrical coils are designed to give way upon the user applying an unfurling action on the chemically-inflatable bag; thus, furnishing a passageway for the chemical reactants to intermix and initiate a chemical reaction. The chemical reaction produces carbon dioxide as a by-product, which expands the chemically-inflatable bag from a collapsed condition to an inflated condition. In the inflated condition, the chemically-inflatable bag fills and protects the integrity of the formed cavity.

19 Claims, 3 Drawing Sheets

DEPLOYING A CHEMICALLY-INFLATABLE BAG WITH AN UNFURLING ACTION

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

Embodiments of the present invention relate to a chemically-inflatable bag that is capable of self-inflating upon applying an unfurling action thereto. More specifically, an exemplary embodiment of the present invention involves providing a chemically-inflatable bag for use as an obstruction in sealing drilled or formed holes.

Typically, these types of holes are dug and used to receive telephone poles or other types of supports. However, if the poles are not immediately placed within the holes, the holes may backfill with debris or rain. Thus, a need arises for an obstruction that can partially or fully fill these holes until a time when the respective poles may be placed therein. Conventional obstructions require the use of mechanical devices for insertion or expansion and may require substantial time and effort to transport and negotiate into a proper position within the holes.

As such, employing emerging technologies to construct a container that self-inflates with minimal user interaction by integrating chemical properties with human ergonomic factors would significantly reduce the inconveniences inherent in the present solutions for providing an obstruction. For instance, in one aspect of the present invention, the self-inflatable container is able to be placed within one of the drilled holes and allowed to fully inflate heightwise before it is fully inflated widthwise, thereby properly filling the drilled hole without the need for any further human action. Accordingly, the self-inflatable container, or chemically-inflatable bag as used hereinafter, provides a robust system to efficiently fill the drilled hole to prevent back fill or to protect a formed cavity from rain-induced erosion.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

Generally, an exemplary embodiment of the present invention relates to a chemically-inflatable bag that may be deployed manually by a user to serve, in instances, as an obstruction within a hole in the ground or in any other formed cavity in any environment (e.g., inflatable to fill a trash can to prevent rain water from entering).

In embodiments, the chemically-inflatable bag is manufactured from a flexible, foldable gas-impermeable material (e.g., high density polyethylene (HDPE)). Generally, HDPE is a suitable material because its properties allow the chemically-inflatable bag to hold the acetic acid while remaining substantially impervious to acetic acid vapors and water over a duration of time. However, the chemically-inflatable bag may be comprised of any material that can act as a barrier to the acid (e.g., fluorinated polyethylene).

Initially, an elongated sleeve of the material may be provided. The elongated sleeve may include one or more seams that run longitudinally, allowing the elongated sleeve. The elongated sleeve may further include an accessible interior for inserting one or more reactants thereto.

A crease may be formed in the elongated sleeve to divide the elongated sleeve into a first section and a second section. In one instance, the crease is formed along an axis that is substantially perpendicular to the seams in the elongated sleeve. In particular, the axis may be located along the elongated sleeve such that the crease bisects a length of elongated sleeve. Upon forming the crease, a releasable seal is generated that provides a watertight barrier between the adjoining first and second sections. This releasable seal may be secured to prevent unintentional release, or compromise, by rolling the crease into a cylindrical coil. Often, rolling the crease involves rolling together a portion of the adjoining first and second sections.

The accessible interior of the elongated sleeve typically includes openings at either end of the length of the elongated sleeve. Generally, each end-opening corresponds with one of the first or second sections. Accordingly, the end-openings are utilized for inserting chemical reactants into the accessible interior. In the specific example, a first reaction may be inserted into the first section via one end-opening, while a second reactant may be inserted into the second section via another end-opening that is opposed to the end-opening of the first section. Upon insertion of the first and second reactants, the end-openings are hermetically sealed to prevent the first and second reactants, or byproducts of a potential chemical reaction therebetween, from escaping. Hermetically sealing the first and second reactants into the interior of the elongated sleeve generates a first and second chamber that correspond with the first and second sections, respectively. That is, the first chamber encloses the first reactant and the second chamber encloses the second reactant, while the releasable seal resists unintentional intermixing of the first and second reactants.

Typically, as discussed above, the chemically-inflatable bag is used to fill a drilled hole to prevent backfill or to protect it from rain-induced erosion by causing the chemically-inflatable bag to expand from a collapsed condition to an inflated condition. In one instance, causing the chemically-inflatable bag to expand includes manually grasping the first chamber and leaving the second chamber unencumbered and generating a moment of inertia in the second chamber by manually applying an unfurling action to the chemically-inflatable bag. Generally, the moment of inertia causes the cylindrical coil to unwind, thereby compromising the releasable seal. Expanding the chemically-inflatable bag may further include utilizing the gravitational force to displace a majority of the first reactant (e.g., fluid substance) from the first chamber into the second chamber via a passageway furnished by the compromised releasable seal. During this displacement, the displaced first reactant is introduced to the second reactant (e.g., powdered substance) residing in the second chamber. This introduction of the first and second reactants, and consequent intermixing, invokes a chemical reaction that produces a quantity of gas capable of expanding the chemically-inflatable bag to an inflated condition.

In one instance, the first and second reactants may be several types of chemical agents including, but not limited to, a sodium bicarbonate and an acetic acid or vinegar. Further, the expansion may be assisted by an inflation device, such as an aerosol can or any other typical acid/based reaction. In the instance above, combining the first and second reactants initiates a chemical reaction that generates a byproduct of carbon dioxide. Generally, the first and second reactants are premeasured such that the chemical reaction generates sufficient amounts of carbon dioxide to fully expand the chemically-inflatable bag to the inflated condition. When expanded to the inflated condition, an outer surface of the elongated sleeve, or portions of the perimeter of the chemically-inflatable bag, contact walls of the formed cavity and frictionally fix the chemically-inflatable bag thereto. Thus, the chemically-inflatable bag acts as an obstruction to solids or liquids entering the formed cavity and to erosion of walls of the formed cavity.

Additional objects, advantages, and novel features of the invention will be set forth in the description that follows and in part will become apparent to those skilled in the art upon examination of the following, or may be learned by practice of the invention.

BRIEF DESCRIPTION OF THE DRAWINGS

Illustrative embodiments of the present invention are described in detail below with reference to the attached drawing figures, which are incorporated by reference herein. In the accompanying drawings, which form a part of the specification and which are to be read in conjunction therewith, and in which like reference numerals are used to indicate like parts in the various views.

DETAILED DESCRIPTION OF THE INVENTION

Figure 1:
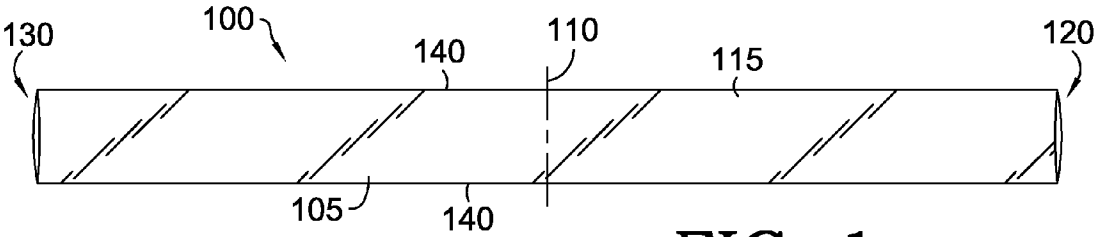
FIG. 1 is a top elevational view of an unrolled elongated sleeve used for constructing a chemically-inflatable bag, in accordance with embodiments of the present invention.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or varying components/materials similar to the ones described in this document, in conjunction with other present or future technologies.

Embodiments provide an apparatus and methods for facilitating a nonlabor intensive, novel process for preventing backfill entering, or environmental factors eroding, walls of a cavity formed in the ground. Generally, preventing involves constructing a chemically-inflatable bag that separates two or more chemical reactants by creases and/or cylindrical coils formed in the chemically-inflatable bag. The creases typically act as watertight releasable seals that separate the chemical reactants while the cylindrical coils resist unintentional compromise of the releasable seals. However, the cylindrical coils are designed to give way upon the user applying an unfurling action on the chemically-inflatable bag; thus, furnishing a passageway for the chemical reactants to intermix and initiate a chemical reaction. The chemical reaction produces carbon dioxide as a by-product, which expands the chemically-inflatable bag from a collapsed condition to an inflated condition. In the inflated condition, the chemically-inflatable bag obstructs foreign items from entering the formed cavity.

In one aspect of the present invention, a method for constructing a chemically-inflatable bag for use as an obstruction in a formed cavity is provided. In one instance, the method includes providing an elongated sleeve that comprises one or more longitudinal seams that substantially traverse a length of the elongated sleeve. Typically, the elongated sleeve has an accessible interior that is reachable via opposed opened ends and an outer surface. A crease is formed in the elongated sleeve by folding the elongated sleeve along an axis that is substantially perpendicular to the longitudinal seams. In one instance, the access generally bisects the length of elongated sleeve. Upon forming the crease, a watertight, releasable seal that divides the interior of the elongated sleeve into a first section and a second section is created.

A first reactant (e.g., acid or other fluid substance) may be inserted into the first section via one opened end of the elongated sleeve and a first chamber may be formed to enclose the first reactant by fixedly sealing the opened end. Also, a second reactant (e.g., metal carbonate or a powdered substance) may be inserted in the second section via a second opened end of the elongated sleeve that is arranged in opposed relation to the opened end of first section. Similar to the first section, a second chamber may be formed in the second section to enclose the second reactant by fixedly sealing the opened end thereof. The releasable seal is maintained against unintentional compromise by winding the crease, and rolling together a portion of the first chamber and a portion of the second chamber, to produce a cylindrical coil. Typically, the process of rolling reduces a realized volume of the first chamber and the second chamber.

In other embodiments of the present invention, a method for deploying an obstruction within the formed cavity by applying an unfurling action to the chemically-inflatable bag is provided. Initially, a chemically-inflatable bag in a collapsed condition is attained. When in an appropriate position, such as at an elevation proximate to the cavity formed in the ground, an unfurling action is applied to the chemically-inflatable bag. Often, the unfurling action comprises at least one of the following steps: retaining the first chamber and leaving the second chamber unencumbered; and creating a moment of inertia in the second chamber by moving the retained first chamber at a rate that causes the cylindrical coil to unwind, thereby compromising the releasable seal. Upon compromising the releasable seal, a portion of the first reactant is displaced from first chamber into the second chamber via a passageway furnished by the compromised releasable seal. Consequently, a chemical reaction is invoked by introducing the displaced portion of the first reactant to the second reactant, where a by-product of the chemical reaction is a gas. As such, the chemically-inflatable bag is expanded to an inflated condition by way of the gas being generated by the chemical reaction.

Referring to the drawings in greater detail and initially to FIG. 1, a top elevational view of an unrolled elongated sleeve 100, used for constructing a chemically-inflatable bag, is depicted. The elongated sleeve 100, as illustrated, is designed according to distinct embodiments of the present invention. Initially, the elongated sleeve 100 includes opened ends 120 and 130 that are positioned opposed to each other. The opened ends 120 and 130 typically provide access to an interior of the elongated sleeve 100.

In a particular embodiment, the elongated sleeve 100 is fabricated by joining one or more articles (e.g., generally rectangular-shaped sheets) that are derived from a flexible, gas-impermeable material. In another embodiment, the elongated sleeve 100 is constructed from one or more layers of material that singly or collectively form a gas-impermeable barrier. A number of types of material are suitable for forming the layer(s) of the elongated sleeve 100. For instance, the elongated sleeve 100 may be formed of flexible polymeric materials that allow the chemically-inflatable bag to be folded to a more compacted state for storage. In another instance, the elongated sleeve 100 may be manufactured of one or more bonding thin-wall sheet-like layers of nylon, polyethylene (PE), or a combination of the two.

In one particular arrangement, the one or more articles joined to form the elongated sleeve 100 are formed of alternating layers of nylon and polyethylene (PE), with the polyethylene layer serving as an innermost layer. The nylon layer functions as a vapor barrier and inhibits stretching of the elongated sleeve 100 as it inflates/expands. Nylon and polyethylene are also advantageous materials because a chemically-inflatable bag made from these materials can stay in a folded position (see FIGS. 2 and 3) for an extended period of time without structural degradation or weak spots being formed. It should be understood that many other types of materials may be utilized in forming the chemically-inflatable bag for use as an inflatable structure with gas-impermeable properties. Furthermore, as used herein, the phrase "gas impermeability" is not meant to be limiting, and may encompass a variety of embodiments where the elongated sleeve 100 possesses gas-impermeable properties for at least some extended length of time, but not necessarily forever. That is, in operation, the chemically-inflatable bag constructed from the elongated sleeve 100 typically functions as only a temporary blocking plug for an earthen hole until the hole is accessed at a later point in time (e.g., for a number of days or weeks) for placement of a telephone pole in the hole. Accordingly, the material(s) chosen for construction of the elongated sleeve 100 are generally sufficiently stable as to be gas impermeable for an extended length of time consistent with the typical operation of the chemically-inflatable bag (i.e., remaining at a fully inflated volume until the blocked hole is accessed).

In other embodiments, the elongated sleeve 100 includes nylon, or nylon attributes that will not develop weak spots when folded for long periods of time or when inflated. That is, weak spots do not develop in the chemically-inflatable bag 200 when inflated because the nylon attributes resist elastic expansion, or nonuniform stretching. In a particular instance of this embodiment, the chemically-inflatable bag 200 is able to withstand at least about 15 psi of internal pressure and is able to maintain that pressure for a duration of at least four weeks.

In yet other embodiments, the elongated sleeve 100 may be formed of PE/nylon/PE layer or nylon/PE layers. In these embodiments, the nylon acts as a vapor barrier and prevents the elongated sleeve 100 from stretching when expanded to the inflated condition. Other materials that are $CO_2$ barriers may also be used within the elongated sleeve 100. However, it should be understood that any suitable material may be used.

In further embodiments, the articles that are joined together at the longitudinal seam(s) 140 to form the elongated sleeve 100 may be sheets of material that are configured with substantially similar profiles. As such, joining may involve overlaying the articles such that the profiles are aligned, and joining one or more segments of the profiles together to create the longitudinal seams 140 that connect the articles to form the elongated sleeve 100. In embodiments, joining may comprise permanently bonding or welding the segments of the profiles (e.g., longitudinal edges) of the articles together to create longitudinal seams 140 that are hermetically sealed.

Pursuant to another embodiment of the present invention, one or more creases (not shown) are formed in the elongated sleeve 100 that are employed to separate substances and/or reactants that are subsequently inserted into the interior of the elongated sleeve 100. As depicted in the embodiment illustrated in FIG. 1, a crease may be formed along a fold line, or axis 110, located on the elongated sleeve 100. As illustrated, the axis 110 represents a crease in the sleeve 100 that, when folded, generates a re-sealable seal 110. In one instance, the axis 110 is located at a general midpoint of the length of the elongated sleeve 100, thereby bisecting the elongated sleeve into substantially comparably sized sections. These sections are referred to hereinafter as a first section 105 and a second section 115. Further, the axis 110 may be angled in an orientation that is substantially perpendicular to the longitudinal seams 140 of the elongated sleeve 100.

Although a single configuration of the axis 110 for guiding crease formation on the elongated sleeve 100 has been described, it should be understood and appreciated that other types of suitable locations and orientations of the axis 110 that provide a marker for forming the crease may be used, and that embodiments of the present invention are not limited to those locations and orientations of the axis 110 described herein. For instance, a plurality of creases may be formed at a plurality of axes located along the length of the elongated sleeve 100 in order to fluidly separate a plurality of reactants residing in the interior of the elongated sleeve 100.

Figure 2:
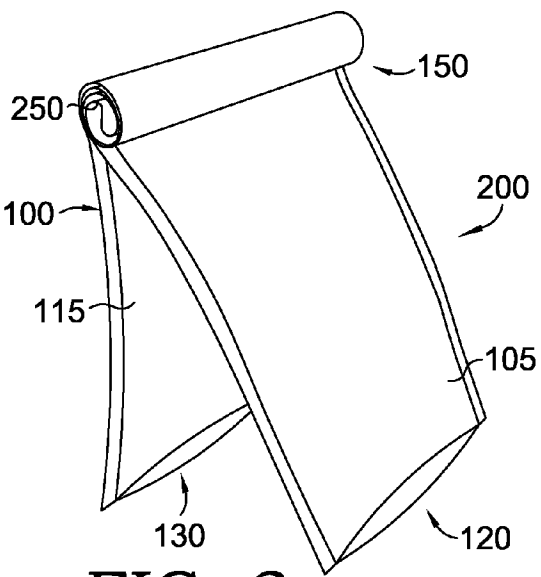
FIG. 2 is a perspective view of the chemically-inflatable bag in a collapsed condition with a cylindrical coil suitable for use in implementing embodiments of the present invention.

Turning now to FIG. 2, a perspective view of the chemically-inflatable bag 200 in a collapsed condition with a cylindrical coil 150 suitable for use in implementing embodiments of the present invention is shown. In an exemplary embodiment, the crease 250 formed at the axis (see reference numeral 110 of FIG. 1) is fashioned as an dramatic fold (e.g., acute angle) in the elongated sleeve 100. As such, this dramatic fold results in a V-shaped corner that brings the first section 105 and the second section 115 together in juxtaposition. That is, the crease 250 situates the first section 105 and the second section 115 in adjacent alignment, as shown in the illustrative embodiment of FIG. 2.

As discussed above, folding the elongated sleeve 100 along the axis to form the crease 250 typically creates a watertight, releasable seal that divides the interior of the elongated sleeve 100 into the first section 105 and the second section 115. To ensure that the releasable seal is not unintentionally comprised during storage or transport of the chemically-inflatable bag, the crease 250 may be rolled into a cylindrical coil 150. Often, rolling the crease 250 into the cylindrical coil 150 involves rolling together a portion of the first section 105 and a portion of the second section 115. Accordingly, the process of rolling reduces a realized volume of the first section 105 and the second section 115, respectively. However, these realized volumes are restored upon applying an unfurling action on the chemically-inflatable bag 200 that unwinds the cylindrical coil 150 and breaks the releasable seal 250, as more fully discussed below.

Figure 3:
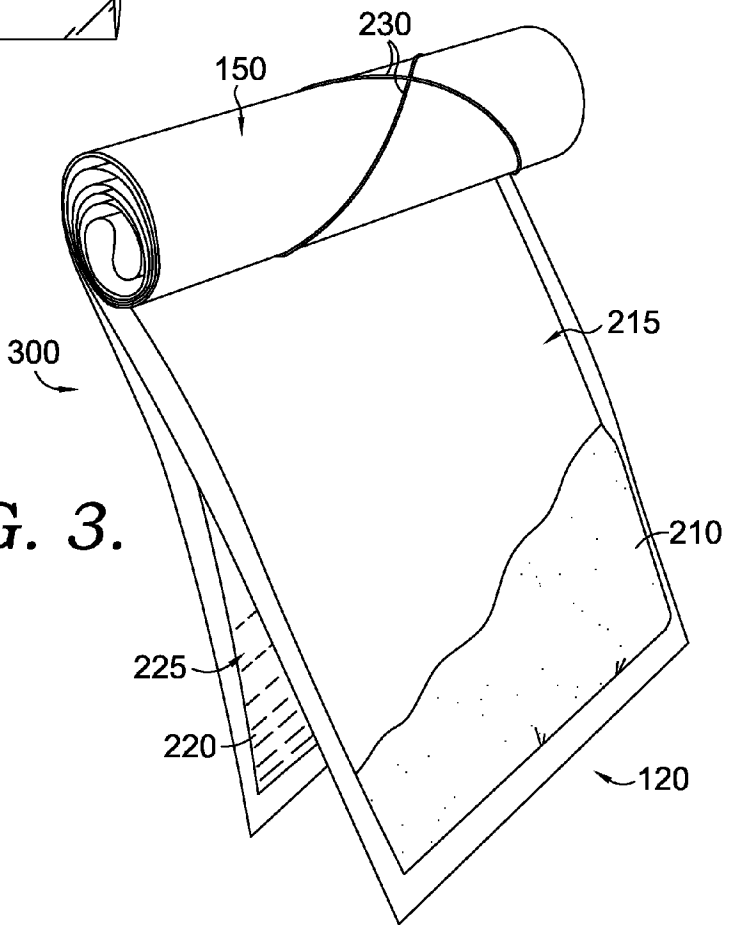
FIG. 3 is a view similar to the view shown in FIG. 2, but with a first and second reactant inserted into the elongated sleeve in accordance with embodiments of the present invention.

As depicted in FIG. 3, the cylindrical coil 150 may be held together by one or more fasteners 230. In embodiments, the fastener(s) 230 are assembled to the cylindrical coil 150 in order to secure the cylindrical coil 150 and to prevent the cylindrical coil 150 from unintentionally unwinding and compromising the releasable seal 250. In a particular embodiment, securing the cylindrical coil 150 by assembling the fastener 230 thereto involves wrapping at least one elastic band about the cylindrical coil 150. The elastic band may be a rubber band, or any other item that can elongate to mount to the cylindrical coil 150 and elastically contract to maintain a configuration of the cylindrical coil 150.

Although one instance of a configuration of the fastener(s) 230 has been described, it should be understood and appreciated by those of ordinary skill in the art that other types of suitable fastener(s) that secure the cylindrical coil 150 may be used, and that embodiments of the present invention are not limited to those fastener(s) 230 as described herein. For instance, the cylindrical coil 150 may be secured by a clip (e.g., a clothes pin) that is automatically released from the cylindrical coil 150 upon a user applying an unfurling action to the chemically-inflatable bag 200.

The openings 120 and 130, discussed above, are accommodated at the ends of the first section 105 and second section 115, respectively, and allow access to the interior of the elongated sleeve 100. Because, the openings 120 and 130 allow access to the interior of the elongated sleeve 100, materials may be placed within the elongated sleeve 100 to promote expansion thereof. With reference to FIG. 3, in embodiments of placing material(s) into the elongated sleeve 100, a first reactant 210 may be inserted into the first section 105 via the first opened end 120 of the elongated sleeve 100. Similarly, a second reactant 220 may be inserted into the second section 115 via a second opened end 130 of the elongated sleeve 100 that may be arranged in opposed relation to the first opened end 120.

Figure 7:
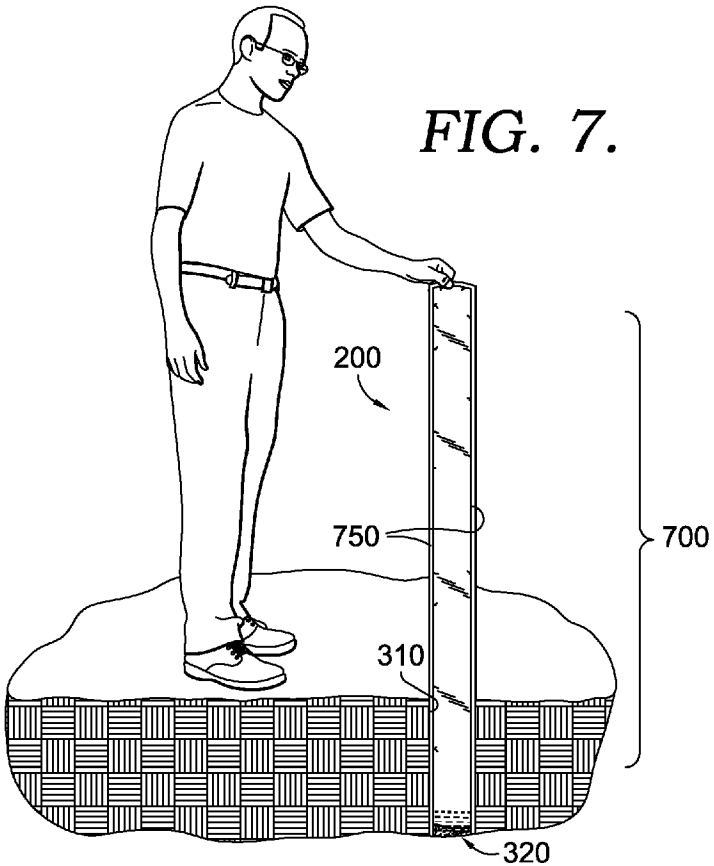
FIG. 7 is a view similar to the view shown in FIG. 6, but with the chemically-inflatable bag expanded to the inflated condition such that the elongated sleeve contacts walls of the formed cavity, in accordance with embodiments of the present invention.

Insertion of the first reactant 210 or the second reactant 220 may be accomplished by placing premeasured amounts of each reactant into the interior of the elongated sleeve to cause a chemical reaction therebetween that generates enough gaseous by-product to expand the chemically-inflatable bag 200 to an inflated condition (see FIG. 7). The premeasured amount may be based on the type of reactants being used, the concentration of the reactants, or any other attributes or characteristics of the reactants that influence the behavior of the chemical reaction therebetween.

In other embodiments, insertion of the reactants may involve injecting, loading, filling, pouring, or any other method of placing reactants within an interior of a container. By way of example, if the first reactant 210 is a fluid substance, insertion of the first reactant 210 may comprise flowing a predetermined quantity of the fluid substance into the first section 105 of the elongated sleeve 100. In another example, the constituent reactants (e.g., the first reactant 210, the second reactant 220, and any other reactants determined useful to initiate or catalyze a chemical reaction) are placed into the interior of the elongated sleeve 100 as separate or joined streams. In yet another example, the first reactant 210 and/or the second reactant 220 are controllably injected into the interior of the elongated sleeve 100 via an outer surface of the elongated sleeve without providing the openings 120 and 130. In this example, the interior is sealed under substantially atmospheric pressure upon performing the controlled injection.

Upon placing the first reactant 210, the second reactant 220, and any other reactants or substances into the interior of the elongated sleeve 100, the openings 120 and 130 are closed to capture the reactants therein. Accordingly, in one embodiment, fixedly sealing the first opened end 120 of the first section 105 (see FIG. 2) forms a first chamber 215 that encloses the first reactant 210 (see FIG. 3). In another embodiment, a second chamber 225 is formed to enclose the second reactant 220 by fixedly sealing the second opened end 130. Fixedly sealing the openings 120 and 130 of the elongated sleeve 100 may comprise bonding (e.g., utilizing heat-sealing techniques, ultrasonic welding, or any other suitable coupling method) or joining the edges of the respective openings 120 and 130 to create a seam. Joining the edges may comprise attaching together overlying side-edge potions, or peripheries, of the articles and/or panels that are used to assemble the elongated sleeve 100. Generally, the seam is linearly oriented and substantially perpendicular to, or simply traverse, the longitudinal seams (see reference numeral 140 of FIG. 1). Also, the seam may be configured as a hermetic seal that prevents the escape of the gaseous by-product of the chemical reaction potentially initiated upon mixing the reactants. Accordingly, by creating the seam to seal the reactants inside the interior of the elongated sleeve, the reactants 210 and 220 are compartmentalized in isolated chambers 215 and 225, respectively, each separated by the releasable seal(s).

At this stage in the construction of the chemically-inflatable bag 200, the interior of the elongated sleeve 100 and the reactants are sealed away from the ambient air and other environment factors, such as moisture and pressure. Further, the reactants are removed from each other, although the chambers 215 and 225 may be situated in adjacent alignment, as governed by the configuration of the cylindrical coil 150. Because reactants are removed from each other, thus deactivated, the chemically-inflatable bag 200 is considered to be in a collapsed condition. In the collapsed condition, the chemically-inflatable bag 200 is in a flexible and loose state and is compact in size. Accordingly, the collapsed condition allows for efficient storage and transportation of numerous chemically-inflatable bags 200.

Although various alternatives of the process for constructing the chemically-inflatable bag 200 have been described, it should be understood and appreciated by those of ordinary skill in the art that other types of suitable procedures may be used or swapped within the process above, and that embodiments of the present invention are not limited to each and every step of those processes described herein.

For example, in one instance, the acetic acid (e.g., technical grade acetic acid) used is less corrosive than many other acids. By using technical grade acetic acid, the reaction with the sodium bicarbonate has increased reliability and control. Typically, the acetic acid is diluted with water to between about 8-30% by volume of acetic acid. In an exemplary embodiment, the acetic acid is diluted to about 10-20% by volume of acetic acid. In one instance of this embodiment, the acetic acid is diluted to about 12-20% by volume of acetic acid. It should be understood that the volume per solution volume (v/v) of acetic acid should vary with the size and shape of the chemically-inflatable bag 200 to be inflated. For instance, the greater the size of the chemically-inflatable bag 200, the greater the volume per solution volume (v/v) of acetic acid.

In embodiments of constructing the chemically-inflatable bag 200 with varied reactants, the second reactant 220 may be sodium bicarbonate powder, which is placed in the second section 115 of the elongated sleeve 100 (e.g., manufactured from HDPE) and sealed to form the second chamber 225. Next, the first reactant 210 may be technical grade acetic acid that is diluted with water to 16% v/v, which is poured into the first section 105 of the elongated sleeve 100 and sealed to form the first chamber 215. Accordingly, the sodium bicarbonate and the acetic acid are secured at the opposite ends of the chemically-inflatable bag 200 and separated by the subsequently formed releasable seal 250. The releasable seal 250 may be then secured by folding the elongated sleeve 100 into the cylindrical coil 150 and securing the cylindrical coil 150 with rubber bands.

In another specific embodiment of the construction process, the first reactant 210 may be sodium bicarbonate tablets while the second reactant 220 may be technical grade acetic acid diluted with water to 20% v/v. The tablets may be placed in the first section 105 and sealed therein, while the acetic acid may be poured into the second section 115 and sealed therein. A crease may be formed in the elongated sleeve 100 at some location between the tablets and acetic acid, thereby providing a releasable seal 250 between the first reactant 210 and the second reactant 220. The releasable seal 250 may be secured by folding together portions of the first section 105 and the second section 115 and by assembling a string to the folded portions.

In still another variation of the construction process within the scope of embodiments of the present invention, the first reactant 210 may be sodium bicarbonate powder while the second reactant 220 may be acetic acid that is diluted with water to a dilution level within a range of 12% v/v to 18% v/v. The powder may be placed on the first section 105 and sealed therein, while the acetic acid may be poured into the second section 115 and sealed therein. One or more releasable seals 250 may be generated to separate the powder and acetic acid. Further, the releasable seal(s) 250 may be temporarily sustained by folding the releasable seal(s) 250 and securing the folds with tape.

Other methods for implementing the construction process that involve multiple bags that operate in conjunction with each other to separate the first reactant 210, the second reactant 220, and possible other reactants are disclosed in Application Ser. No. 09/950,986 filed Sep. 12, 2001, issued as U.S. Pat. No. 6,619,387, the contents of which are herein incorporated by reference.

Turning now to FIGS. 4-7, a method for expanding the chemically-inflatable bag 200 from a collapsed condition 400 to an inflated condition 700. An embodiment of the method summarily includes one or more of the following steps: providing the chemically-inflatable bag 200 in the collapsed condition with the crease formed in the chemically-inflatable bag 200 that creates a watertight, releasable seal 110 dividing the interior into the first chamber 215 that encloses a quantity of a powdered substance (e.g., the first reactant 210) and the second chamber 225 that encloses a quantity of a fluid substance (e.g., the second reactant 220); manually grasping the second chamber 225 and leaving the first chamber 215 unencumbered; generating a moment of inertia in the first chamber 215 by manually applying an unfurling action to the chemically-inflatable bag 200; causing the cylindrical coil to unwind; compromising the releasable seal 110; and utilizing a gravitational force to displace a majority of the quantity of the fluid substance 220 from second chamber 225 into the first chamber 215.

Figure 4:
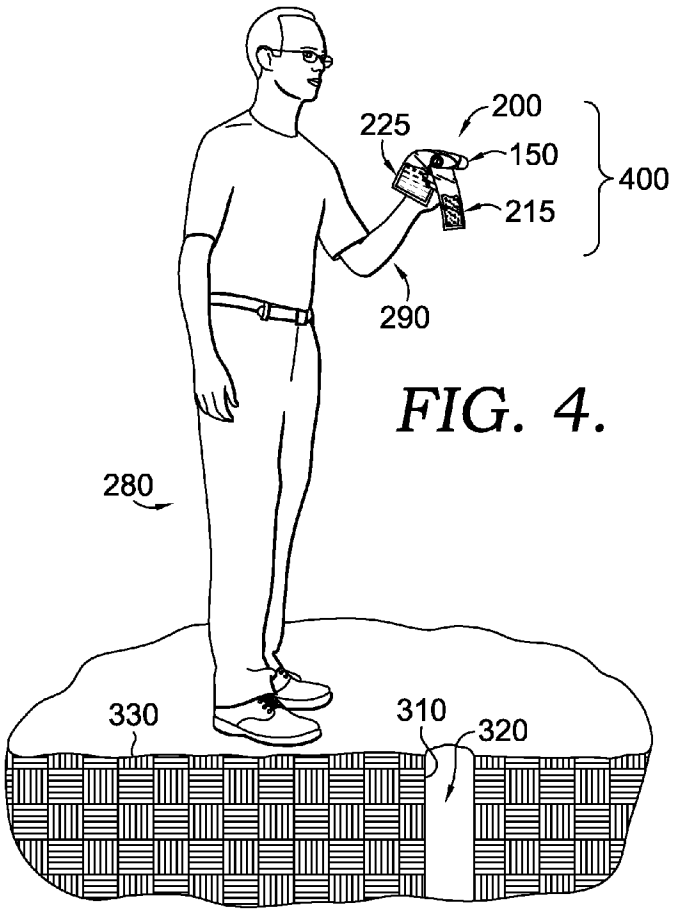
FIG. 4 is a perspective view of a user grasping a second chamber of the chemically-inflatable bag above a cavity formed in the ground, in accordance with an embodiment of expanding the chemically-inflatable bag from a collapsed condition to an inflated condition.

Variations on the method above will now be discussed with reference to FIG. 4. Generally, FIG. 4 depicts a perspective view of a user 280 grasping the second chamber 225 of the chemically-inflatable bag 200 above a cavity 320 formed in the ground 330, in accordance with an embodiment of expanding the chemically-inflatable bag 200 from the collapsed condition 400 to the inflated condition 700. When the user 280 is grasping the second chamber 225 of the chemically-inflatable bag 200, the first chamber 215 that encloses the first reactant 210 is suspended from the cylindrical coil 150. Typically, when being grasped, the chemically-inflatable bag 200 is held folded and bundled by the fastener(s) 230.

As discussed above, the cylindrical coil 150 preserves the integrity of the releasable seal (not shown) when the user is not intentionally attempting to break the releasable seal. Accordingly, when the chemically-inflatable bag 200 is oriented in the position illustrated in FIG. 4, the reactants 210 and 220 are chemically separate and no reaction is allowed to occur therebetween. Further, the cylindrical coil 150 resists compromise of the releasable seal even when performing such tasks as storing, transporting, or manually handling the chemically-inflatable bag 200.

In another embodiment, retaining the second chamber 225 and leaving the first chamber 215 unencumbered involves manually grasping the second chamber 225 and allowing the first chamber 215 to freely hang from the cylindrical coil 150. In embodiments, the fastener(s) 230 are assembled to the cylindrical coil 150 in a manner that resists unwinding of the cylindrical coil 150 when loaded by a weight of the first reactant 215 enclosed in the freely hanging first chamber 215. However, the fastener(s) 230 are expelled from the cylindrical coil 150 when the weight of the first reactant 215 is combined with a circumferential acceleration generated by the unfurling action, discussed below.

Figure 5:
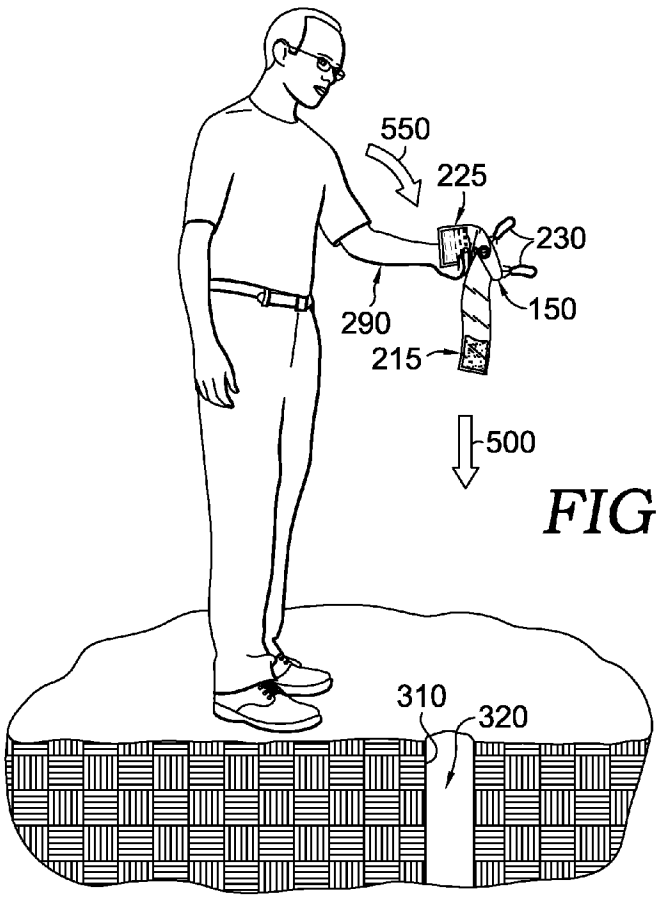
FIG. 5 is a view similar to the view shown in FIG. 4, but with the user in a process of applying an unfurling action on the chemically-inflatable bag, in accordance with embodiments of the present invention.

With reference to FIG. 5, the unfurling action will now be discussed. Generally, FIG. 5 depicts a view similar to the view shown in FIG. 4, but with the user 280 in a process of applying the unfurling action on the chemically-inflatable bag 200, in accordance with embodiments of the present invention. In an exemplary embodiment, applying the unfurling action to the chemically-inflatable bag 200 is represented by reference numeral 550. The unfurling action may be performed manually by the user or a plurality of users, or automatically by a machine that can cause the cylindrical coil 150 to unwind, thus, compromising the releasable seal. In embodiments, the unfurling action 550 includes retaining by the user 280 or the machine (not shown) the second chamber 225 and leaving the first chamber 215 unencumbered. Then, by moving the retained second chamber 225, a moment of inertia is created in the first chamber 215. The movement is typically a thrust with acceleration at a rate that causes the fastener(s) 230 to disengage from the cylindrical coil 150. Based on the type and number of the fastener(s) 230 used for retaining the cylindrical coil 150, varying thresholds of acceleration rates have to be met to release the fastener(s) 230 from the cylindrical coil 150. Upon releasing the fastener(s) 230 from the cylindrical coil 150, the residual moment of inertia in the first chamber 215 causes the cylindrical coil 150 to unwind, thereby compromising the releasable seal.

In an exemplary embodiment, creating a moment of inertia in the first chamber 215 is accomplished by moving the retained second chamber 225 in a downward manner. For instance, the downward manner of movement may be downwardly swinging the first chamber 215 about the cylindrical coil 150 in a direction consistent with the formed cavity 320. The downward swing may be achieved by the user 280 swinging an arm 290 downward toward the ground 330 at a particular rate and then lifting upwards to create a spike in tension on the cylindrical coil 150. As the spike in tension reaches a threshold, the fastener(s) 230 are disengaged, the cylindrical coil 150 unfurls, and the first chamber 215 moves in a downward direction 500, as influenced by a conjunction of a gravitational force and the moment of inertia created by applying the unfurling action 550.

Figure 6:
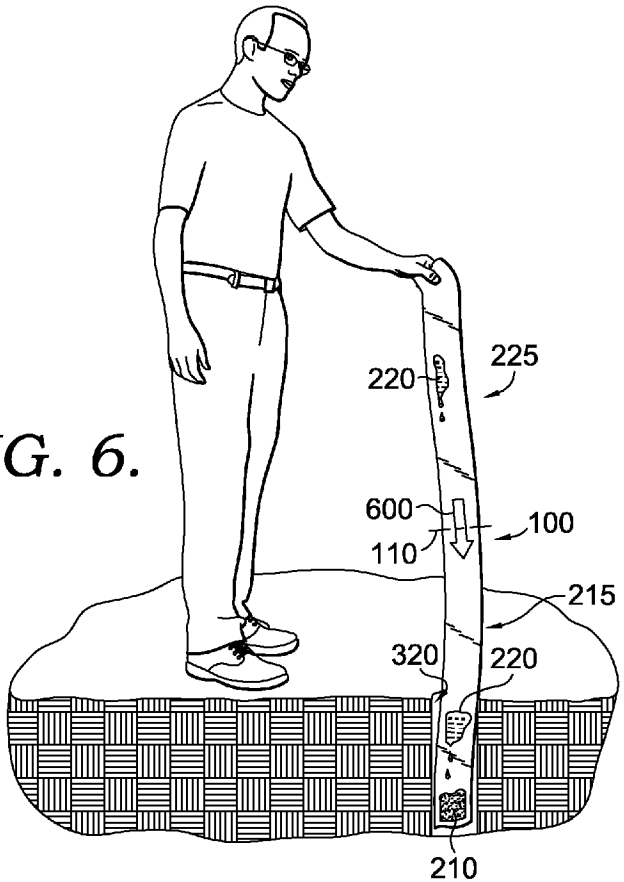
FIG. 6 is a view similar to the view shown in FIG. 5, but with the chemically-inflatable bag substantially unfurled and positioned within the formed cavity, in accordance with embodiments of the present invention.

With reference to FIG. 6, a view similar to the view shown in FIG. 5 is illustrated, but with the chemically-inflatable bag 200 substantially unfurled and positioned within the formed cavity 320, in accordance with embodiments of the present invention. As the first chamber 215 is moved in the downward direction 500 (see FIG. 4), typically under the influence of the moment of inertia, a portion of the first chamber 215 is caused to enter the formed cavity 320. Preceding, concomitant with or subsequent to, the portion of the first chamber 215 entering the cavity 320, the releasable seal 110 is compromised allowing the second reactant 220 to traverse to the first reactant 210 and initiate a chemical reaction. In one instance, causing the second reactant 220 to traverse includes displacing a portion of the second reactant 220 from second chamber 225 retained by the user 280 into the first chamber 215 via a passageway 600 furnished by the compromised releasable seal 110. The displacement may range from a slow seepage of the second reactant 220 downward to meet the first reactant 210, or a rapid evacuation from the second chamber 225 to the first chamber 215.

Upon introducing the reactants 210 and 220 via the passage 600, and the subsequent intermixing thereof, a chemical reaction is invoked that produces a by-product of a gas (e.g., carbon dioxide) as well as other by-products. In operation, the gaseous by-product (not shown) generated by the chemical reaction is substantially responsible for expanding the chemically-inflatable bag 200 to the inflated condition (see reference numeral 700 of FIG. 7). In one instance, based on the rate of displacement of the second reactant 220 via the passageway 600, as well as the concentration/quantity of the chemical reactants 210 and 220, and any catalysts provided, a rate of gaseous by-product generation is controlled. By way of example, a swift displacement in tandem with high concentrations of reactants 210 and 220 (e.g., 20% v/v of acetic acid) will result in rapid generation of the gaseous by-product and, thus, rapid inflation of the chemically-inflatable bag 200.

In another example, the first chamber 215 may enclose a premeasured amount of first reactant 210 and the second chamber 225 may enclose a premeasured amount of the second reactant 220 in order to control the rate of the chemical reaction and the amount of the gaseous by-product produced. In operation, upon introducing a majority of the premeasured amount of first reactant 210 to a majority of the premeasured amount of the second reactant 220 in the first chamber 215, the chemical reaction to generate carbon dioxide is invoked and the generated carbon dioxide creates internal pressure within the chemically-inflatable bag 200. Typically, the internal pressure is greater than atmospheric pressure and causes the chemically-inflatable bag 200 to expand until it reaches the inflated condition 700 (see FIG. 7). In a variation of this example, only the second reactant 220 (e.g., acetic acid) is premeasured. As such, the amount of inflation of the chemically-inflatable bag 200 is controlled by the amount of acetic acid released, because acetic acid is the limiting reagent.

In one embodiment of breaking the releasable seal 110 and initiating the chemical reaction, the second reactant 220 may comprise a fluid substance (e.g., citric acid) that is allowed to flow through the passageway 600 into the first reactant 210, which comprises a solid substance (e.g., bicarbonate of soda). In this embodiment, the passageway 600 results from a downward force of the fluid substance contacting the releasable seal 110, generating an area of high stress concentration that compromises the releasable seal 110, and forming a conduit through the releasable seal 110 once broken.

Although several different types and concentrations of the reactants 210 and 220 have been described, it should be understood and appreciated that other types of suitable reactants/agents/substances that provide for the generation of any gaseous by-product may be used, and that embodiments of the present invention are not limited to those acid and bicarbonate chemical combinations described herein. For instance, it should be understood that vinegar or any other suitable substance with similar properties to acetic acid may be used. In other embodiments, an inflation device (e.g., aerosol can) may be used to assist in the inflation of the chemically-inflatable bag 200.

Turning to FIG. 7, a view similar to the view shown in FIG. 6 is depicted, but with the chemically-inflatable bag 200 expanded to the inflated condition 700 such that the elongated sleeve 100 contacts walls 310 of the formed cavity 320, in accordance with embodiments of the present invention. As discussed above, the unfurling action (see reference numeral 550 of FIG. 5) may involve unwinding the cylindrical coil 150 (see reference numeral 150 of FIG. 5) at an elevation generally above the formed cavity 320. As discussed herein, the phrase "formed cavity" 320 is not meant to be limiting, but may encompass any hole, aperture, or void that is capable of receiving a plug. For instance, as depicted at FIG. 7, the formed cavity may be a hole bored into the ground 330 that can receive a portion, or majority, of the chemically-inflatable bag 200. In a particular embodiment, the formed cavity 320 is a hole bored in the ground 330 that is shaped to receive and support a telephone pole, while the elongated sleeve (see reference numeral 100 of the FIG. 1) is shaped such that chemically-inflatable bag 200, when in the inflated condition, substantially fills an inner circumference of the walls 310 of the bored hole. By way of example, the chemically-inflatable bag 200, when expanded, may have an outer circumference within the range of 18 to 24 inches in diameter and a length of up to 6 feet. However it should be understood that virtually any diameter and any length of the chemically-inflatable bag 200 could be used. Further, the chemically-inflatable bag 200 may be shaped and sized in any manner when expanded (e.g., cube, sphere, and the like) to accommodate the shape and size of the destination-formed cavity 320, and is not limited to a cylinder.

In other embodiments, the chemically-inflatable bag 200 is substantially gas-tight and is of a shape such that it can be placed into the formed cavity 320 upon completion of expansion to the inflated condition. Or, the chemically-inflatable bag 200 may be configured in size and shape such that the outer surface 750 does not fully inflate and fully expand to an inner circumference of the formed cavity 320 until the chemical reaction is exhausted and the chemically-inflatable bag 200 is just reaching a full inflation.

As depicted in FIG. 7, incident to a portion of the first chamber 215, or a majority of the first chamber 215 and the second chamber 225 (not shown), entering the formed cavity 320 as well as the chemically-inflatable bag 200 expanding to the inflated condition 700, the fully expanded chemically-inflatable bag 200 may fill a substantial portion of the formed cavity 320. Accordingly, in embodiments, the inflated condition 700 is considered to be achieved upon an outer surface 750 of the elongated sleeve (see reference numeral 100 of FIG. 1) contacting the wall(s) 310 of the formed cavity 320. Because, the internal pressure of the chemically-inflatable bag 200 in the inflated condition causes the chemically-inflatable bag 200 to assume a substantially rigid manifestation, fluids are obstructed from entering into the formed cavity 320 and the walls 310 of the formed cavity 320 are supported against wind- or water-based erosion. In particular instances of the present invention, the chemically-inflatable bag 200 in the inflated condition is used to fill or cap a drilled hole to prevent backfill or to protect it from rain. Accordingly, the rigid manifestation in combination with a volume assumed by the chemically-inflatable bag 200, when expanded, usefully serves to support an internal structure of the formed cavity and, among other things, blocks foreign objects from prematurely filling a void within the formed cavity 320.

In one embodiment, not shown in the FIGS. 1-7, the chemically-inflatable bag 200 is partially or fully contained within a woven polypropylene outer container. This woven polypropylene layer acts as an abrasion and puncture barrier. It may be folded with chemically-inflatable bag 200 in the collapsed condition 400, so that both are folded, or may be installed during or after expansion to the inflated condition 700. Preferably, the woven polypropylene layer and chemically-inflatable bag 200 are substantially clear so that the acetic acid and sodium bicarbonate can be viewed to determine whether the chemical reaction has started and the current stage of the chemical reaction. Also, in embodiments, the woven polypropylene has 10-12 strands per inch. It should be understood and appreciated that other protective covers may be used to withstand puncture forces that may, potentially, deflate the chemically-inflatable bag 200 if the protective cover is not provided.

The description above depicts examples of various chemically-inflatable bags 200, methods for constructing these chemically-inflatable bags 200, and processes for inflating the bags 200 that are within the scope of this invention. These examples are not meant in any way to limit the scope of this invention. Further, while not meant to be limiting, the chemically-inflatable bags 200 may be deployed in any environment and, once deployed, may withstand environmental factors for a duration of time that is greater than a maximum lag time between drilling a hole in a construction setting and installing an item in the hole for which it was drilled.

From the foregoing, it will be seen that this invention is one well-adapted to attain all the ends and objects herein above set forth together with other advantages which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A method for constructing a chemically-inflatable bag for use as an obstruction in a formed cavity, the method comprising:

providing an elongated sleeve that includes one or more longitudinal seams that substantially traverse a length of the elongated sleeve, wherein the elongated sleeve having an accessible interior;

folding the elongated sleeve along an axis that is substantially perpendicular to the one or more longitudinal seams to form a crease, wherein the crease creates a watertight, releasable seal that divides the interior of the elongated sleeve into a first section and a second section;

inserting a first reactant into the first section via a first opened end of the elongated sleeve;

forming a first chamber to enclose the first reactant by fixedly sealing the first opened end;

inserting a second reactant in the second section via a second opened end of the elongated sleeve that is arranged in opposed relation to the first opened end;

forming a second chamber to enclose the second reactant by fixedly sealing the second opened end; and rolling together a portion of the first chamber and a portion of the second chamber to produce a cylindrical coil, wherein the process of rolling reduces a realized volume of the first chamber and the second chamber, wherein the cylindrical coil is selectively unwound upon applying an unfurling action to the chemically-inflatable bag, and wherein the unfurling action comprises:

(a) retaining the first chamber and leaving the second chamber unencumbered; and (b) creating a moment of inertia in the second chamber by moving the retained first chamber at a rate that causes the cylindrical coil to unwind, thereby compromising the releasable seal.

2. The method of claim 1, further comprising fabricating the elongated sleeve from at least one flexible, foldable, gas-impermeable article by attaching an end of the at least one article to another end of the at least one article.

3. The method of claim 1, wherein folding the elongated sleeve along the axis comprises fashioning an acute angle in the elongated sleeve that substantially bisects the length of the elongated sleeve such that the first section and the second section are comparable in size.

4. The method of claim 1, further comprising securing the cylindrical coil by assembling at least one fastener thereto, wherein the at least one assembled fastener is configured to prevent the cylindrical coil from unintentionally unwinding and compromising the releasable seal.

5. The method of claim 4, wherein securing the cylindrical coil by assembling at least one fastener thereto comprises wrapping at least one elastic band about the cylindrical coil.

6. The method of claim 5, wherein the at least one fastener is configured to disengage from the cylindrical coil upon applying an unfurling action thereto.

7. The method of claim 6, wherein, incident to disengaging the at least one fastener from the cylindrical coil by applying the unfurling action, the cylindrical coil is configured to unwind and compromise the releasable seal, thereby allowing the first reactant to be introduced to the second reactant.

8. The method of claim 1, wherein the cylindrical coil situates the first chamber and the second chamber in adjacent alignment.

9. The method of claim 1, wherein the first reactant and the second reactant are configured to chemically react when introduced to one another, and wherein a by-product of the chemical reaction is gas.

10. The method of claim 9, wherein the first reactant is an acid and the second reactant is a metal carbonate, and wherein the chemical reaction, which occurs incident to introducing the first reactant to the second reactant, produces carbon dioxide gas as the by-product.

11. The method of claim 1, wherein providing an elongated sleeve comprises:

providing a pair of generally rectangular sheets derived from a non-extensible, malleable, gas-impermeable material, wherein the generally rectangular sheets are configured with substantially similar profiles;

overlaying the pair of generally rectangular sheets such that the profiles are aligned; and joining one or more segments of the profiles together to form the one or more seams that connect the pair of generally rectangular sheets, wherein the one or more seams are hermetically sealed.

12. A method for deploying an obstruction within a formed cavity by applying an unfurling action to a chemically-inflatable bag, the method comprising:

providing the chemically-inflatable bag in a collapsed condition, wherein the chemically-inflatable bag comprises an elongated sleeve that includes a first chamber that encloses a first reactant and a second chamber that encloses a second reactant;

providing a crease in the elongated sleeve that, when rolled into a cylindrical coil and when at least one fastener is assembled to the cylindrical coil, operates as a releasable seal that resists unintentional mixing of the first reactant and the second reactant;

applying an unfurling action to the chemically-inflatable bag, wherein the unfurling action comprises:

(a) retaining the first chamber and leaving the second chamber unencumbered; and (b) creating a moment of inertia in the second chamber by moving the retained first chamber at a rate that causes the at least one fastener to disengage from the cylindrical coil and that causes the cylindrical coil to unwind, thereby compromising the releasable seal;

displacing a portion of the first reactant from the first chamber into the second chamber via a passageway furnished by the compromised releasable seal;

invoking a chemical reaction by introducing the displaced portion of the first reactant to the second reactant, wherein a by-product of the chemical reaction is a gas; and expanding the chemically-inflatable bag to an inflated condition with the gas being generated by the chemical reaction.

13. The method of claim 12, wherein retaining the first chamber and leaving the second chamber unencumbered comprises manually grasping the first chamber and allowing the second chamber to freely hang from the cylindrical coil, and wherein the at least one fastener is assembled to the cylindrical coil in a manner that resists unwinding of the cylindrical coil when loaded by a weight of the second reactant enclosed in the freely hanging second chamber.

14. The method of claim 12, wherein creating the moment of inertia in the second chamber by moving the retained first chamber comprises downwardly swinging the second chamber about the cylindrical coil in a direction consistent with the formed cavity.

15. The method of claim 12, wherein the unfurling action further comprises:

unwinding the cylindrical coil at an elevation generally above the formed cavity; and directing the moment of inertia of the second chamber to cause a section of the second chamber to enter the formed cavity.

16. The method of claim 15, further comprising, incident to the section of the second chamber entering the formed cavity, expanding the chemically-inflatable bag to the inflated condition, wherein the inflated condition is achieved when an outer surface of the elongated sleeve contacts a wall of the formed cavity.

17. The method of claim 16, wherein the first chamber encloses a pre-measured amount of first reactant and the second chamber encloses a premeasured amount of the second reactant, the method further comprising:

introducing a majority of the premeasured amount of first reactant to a majority of the premeasured amount of the second reactant in the second chamber; and invoking the chemical reaction to generate carbon dioxide, wherein the generated carbon dioxide creates internal pressure within the chemically-inflatable bag, and wherein the internal pressure is greater than atmospheric pressure.

18. The method of claim 17, wherein the internal pressure of the chemically-inflatable bag in the inflated condition causes the elongated sleeve to assume a substantially rigid manifestation that obstructs fluids from entering into the formed cavity.

19. A method for expanding a chemically-inflatable bag from a collapsed condition to an inflated condition, the method comprising:

providing the chemically-inflatable bag in the collapsed condition with an interior, wherein a crease is formed in the chemically-inflatable bag that creates a watertight, releasable seal dividing the interior into a first chamber that encloses a quantity of a fluid substance and a second chamber that encloses a quantity of a powdered substance, and wherein the releasable seal resists unintentional compromise upon rolling the crease into a cylindrical coil;

manually grasping the first chamber and leaving the second chamber unencumbered;

generating a moment of inertia in the second chamber by manually applying an unfurling action to the chemically-inflatable bag, wherein the moment of inertia causes the cylindrical coil to unwind, thereby compromising the releasable seal;

utilizing a gravitational force to displace a majority of the quantity of the fluid substance from the first chamber into the second chamber via a passageway furnished by the compromised releasable seal and to introduce the displaced majority of the quantity of the fluid substance to the quantity of the powdered substance, wherein the introduction invokes a chemical reaction that produces a quantity of gas capable of expanding the chemically-inflatable bag to an inflated condition.

* * * * *